United States Patent [19]

Heap

[11] 4,277,005

[45] Jul. 7, 1981

[54] APPARATUS FOR FOLDING GARMENTS SUCH AS SHIRTS

[75] Inventor: Peter Heap, Ashby de-la-Zouch, England

[73] Assignee: IROPA (Textile Accessories) Ltd., Leicester, England

[21] Appl. No.: 47,247

[22] Filed: Jun. 11, 1979

[30] Foreign Application Priority Data

Jun. 15, 1978 [GB] United Kingdom ..... 27013/78

[51] Int. Cl.[3] ..... A41H 33/00

[52] U.S. Cl. ..... 223/37

[58] Field of Search ..... 223/2, 3, 27, 28, 35, 223/37, 38

[56] References Cited

U.S. PATENT DOCUMENTS

| | | | |
|---|---|---|---|
| 2,853,215 | 9/1958 | Steele | 223/37 |
| 3,181,747 | 5/1965 | Lucius et al. | 223/37 |
| 3,391,839 | 7/1968 | Gwinn et al. | 223/37 |
| 3,419,199 | 12/1968 | Lornitzo | 223/37 |
| 3,477,619 | 11/1969 | Lee | 223/37 |
| 3,638,841 | 2/1972 | Tucci | 223/38 |
| 4,106,260 | 8/1978 | King | 223/37 |

FOREIGN PATENT DOCUMENTS 764611 12/1956 United Kingdom .

*Primary Examiner*—Louis Rimrodt

*Attorney, Agent, or Firm*—Blanchard, Flynn, Thiel, Boutell & Tanis

[57] ABSTRACT

Apparatus for folding garments such as shirts, characterized in that it comprises a forming plate at which a garment is to be folded, a plate, at one end of the forming plate, which has means for moving it to overlie that plate, a reciprocable plate at each side of the apparatus for folding a respective side part of a garment about a line substantially parallel to the longitudinal axis of the garment, a member for folding a tail of the garment over the rest of the garment, and a device for tucking in the tail of a partly folded garment.

9 Claims, 6 Drawing Figures

FIG.1
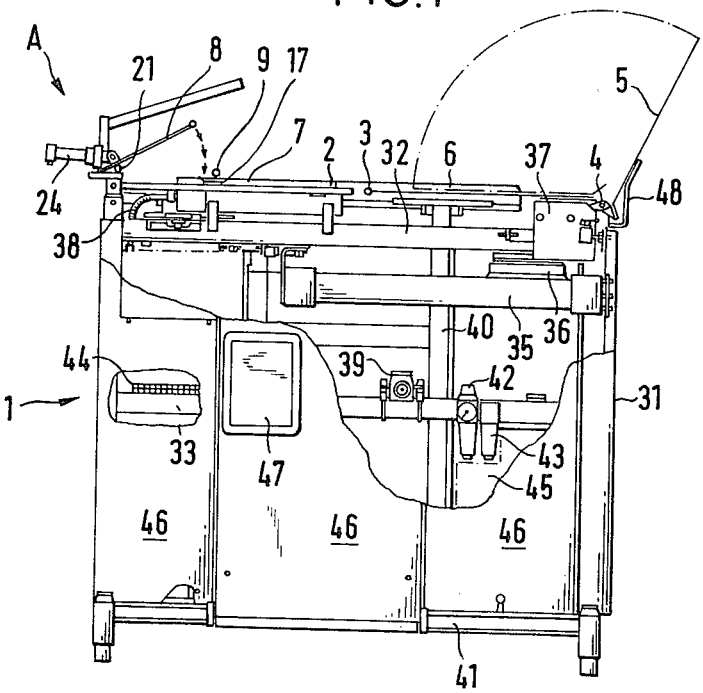
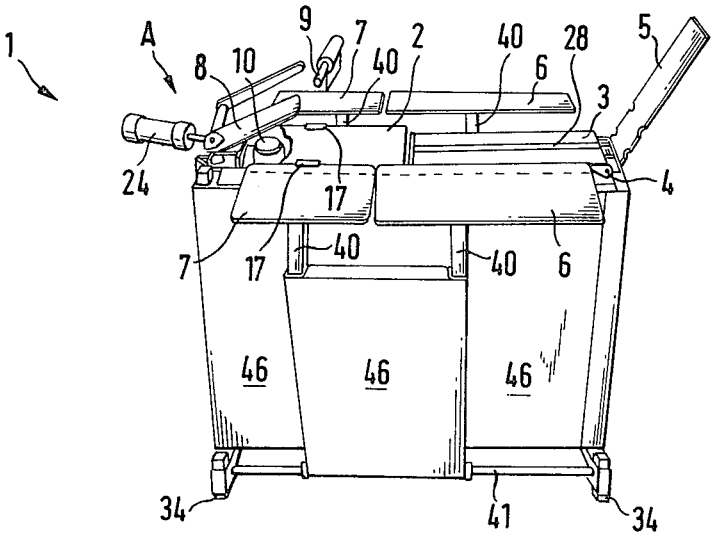
FIG.2

APPARATUS FOR FOLDING GARMENTS SUCH AS SHIRTS

FIELD OF THE INVENTION

The invention relates to apparatus for folding garments such as shirts, in which movable plates cooperate to fold a garment on a forming plate.

BACKGROUND OF THE INVENTION

A shirt folding and pressing machine has been proposed which comprises a forming plate, reciprocable side plates, plates for folding a tail of the shirt over the remainder of the shirt, and a stapler for securing folded-over parts of the shirt together. However, using this machine it is only possible to hold the tail of the shirt with staples. Sometimes it is desirable to avoid the use of staples to hold the tail of the shirt in position, and this is not possible with the proposed machine.

It is thus an object of the invention to provide apparatus for folding garments which seeks to avoid these disadvantages.

In accordance with the invention there is provided apparatus for folding garments such as shirts, characterized in that it comprises: a forming plate at which a garment is to be folded; a plate, at one end of the forming plate, which has means for moving it to overlie that plate; a reciprocable plate at each side of the apparatus for folding a respective side part of a garment about a line substantially parallel to the longitudinal axis of the garment; a member for folding a tail of the garment over the rest of the garment; and a device for tucking in the tail of a partly folded garment.

The advantages which may be obtained from the invention consist particularly in the provision of garment folding apparatus in which there is a device for tucking in a tail of the garment without the requirement that it be stapled in position.

Apparatus for folding garments is hereinafter described, by way of example, with reference to the accompanying drawings.

BRIEF DESCRIPTION OF THE DRAWINGS

FIG. 1 shows a side elevational view of the apparatus, with part broken away for clarity, in accordance with the present invention.

FIG. 2 shows a perspective view of the apparatus of FIG. 1.

DETAILED DESCRIPTION

Figure 3:
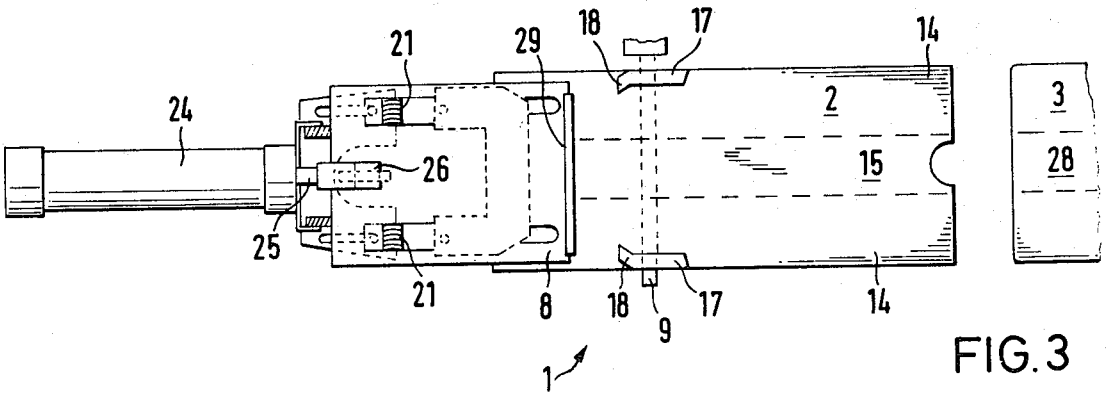
FIG. 3 is a plan view, to an enlarged scale, of the part of the apparatus indicated by the arrow 'A' in FIGS. 1 and 2.

Referring to the drawings, there is shown an apparatus 1 for folding a garment such as a shirt (not shown). The apparatus 1 comprises a forming plate 2 shown in position above a heating plate (not shown) which is generally horizontal and defines a supporting plane for the garment. A first reciprocable plate 3 is situated at the right hand end (as viewed in the drawings) of the forming plate 2 and acts as a support means for the tail portion of the shirt. The plate 3 is pivotable about a horizontal axis 4. A shirt tail folding plate 5 is pivotally connected to the plate 3 about the horizontal axis 4 so that it is movable through the arc shown in chain-dotted lines in FIG. 1. At each side of the apparatus 1 there is a respective pair of plates 6 and 7. At the left hand end (as viewed in the drawings) there is a tiltable plate 8 for tucking in the tail of a shirt. There is a device mounted on one side of the apparatus and which is reciprocable transversely of the apparatus for holding and guiding the tail of the shirt so that the tail is folded about a straight line defined by the rod-like guide 9. Finally the apparatus includes a collar expander 10 of known construction and operation.

Figure 5:
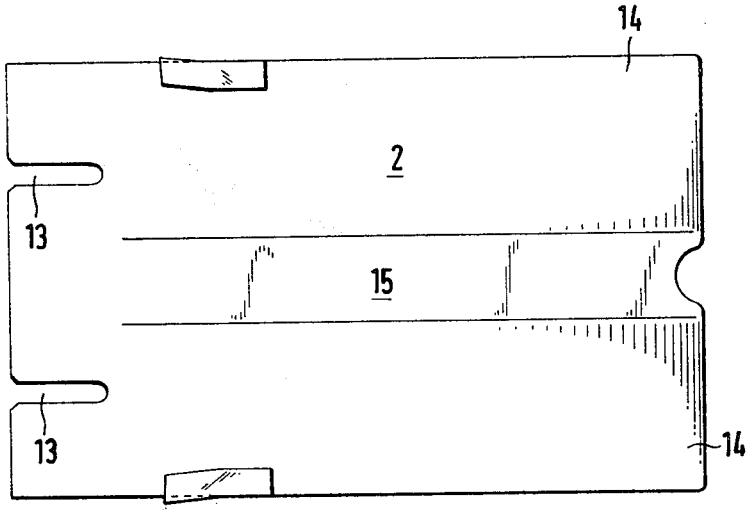
FIGS. 5 and 6 show, to an enlarged scale, plan and end elevational views of a forming plate of the apparatus.
Figure 6:
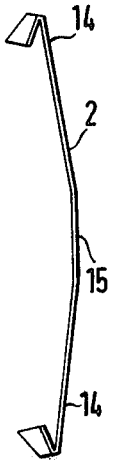

The forming plate 2 is secured to a bracket 11 (FIGS. 3 and 4) as by bolts 12 which pass through slots 13 (FIG. 5) so that the position of the plate 2 can be adjusted to the left or to the right when those bolts 12 are loosened. The forming plate 2 has two lateral edge portions 14 inclined at 8° to the horizontal (see FIGS. 5 and 6) with a flat part 15 therebetween, which flat part 15 acts as a button retainer. Two opposed lugs 17 each with a raised and inwardly directed forward part 18 are secured to the forming plate 2 to form a 'V'-guide of 30° opening for the tiltable plate 8 and to raise the shirt.

The heating plate has butts or strips (not shown) at the side for positioning a template.

Figure 4:
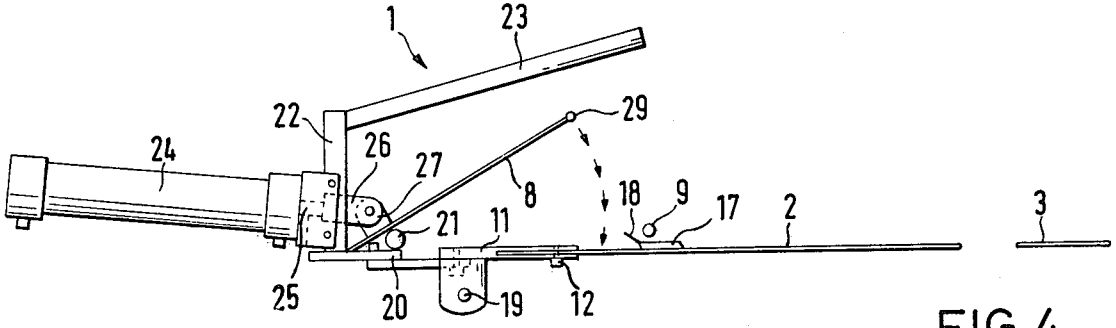
FIG. 4 is a side view, to the same scale, of the part of the apparatus shown in FIG. 3.

The bracket 11 is pivoted to a frame of the apparatus 1 for movement about a horizontal axis 19 and is itself secured to a plate 20 which carries two spaced cylindrical bosses 21 mounted with the plane surfaces vertical. The plate 20 in turn carries an upright yoke or mounting member 22 from the upper (as viewed) part of which fixedly projects a member 23 which acts both as a counterbalance arm and as a lifting handle. (The member 23 is omitted from FIG. 3 for clarity.) To the yoke 22 there is secured a fluidpressure cylinder housing 24 which has a slidable piston 25 carrying a knuckle 26 on which is pivoted a lug 27 secured to the tiltable plate 8 which rests on the lugs 21 as shown in FIGS. 1 and 4. The forming plate 2, tiltable plate 8, cylinder 24 and arm 23 thus form one unit pivotable about the horizontal axis 19.

The heating plate is flat and has a longitudinally extending recessed channel in it to act as a button guide. The plate 3 also has a channel 28 (FIG. 2) in it aligned with the channel of the heating plate and also acting as a button guide.

The tiltable plate 8 is generally rectangular and has a rounded free end 29 for facilitating "rolling" of the shirt over plate 8 during tucking in so that the material of the shirt is not wrinkled or snagged.

The plates 2, 3, 5, 6, 7 and 8 are moved by pneumatic cylinders. Thus the cylinder 24 is a pneumatic cylinder of 20 cm stroke. However, it will be understood that any means may be employed for movement of the different plates.

In order to fold a shirt, and with the forming plate 2 in an upward raised position (not shown), a buttoned shirt is laid with its front side facing downward on the heating plate and on the plate 3, and in doing so the collar is positioned to lie around the collar expander 10, which extends up into the collar which opens downwardly. The buttons of the shirt are laid in the channels of the heating plate and of the plate 3, an operator of the apparatus ensuring that the buttons are correctly positioned in these channels. A template (not shown) e.g. of cardboard or other stiff card is then laid on the rear or upper side of the shirt. The sheet has a protrusion which is inserted into the collar for holding it in place. The collar expander 10 is then actuated to hold fast the shirt in this area, whereby the collar is expanded to its full size. One can, however, also proceed in an opposite manner, so that the collar expander is first actuated and the form, carton or the like is laid on afterward. One can proceed in various ways depending on how the shirt is to be folded. One way consists in folding one sleeve across the template, so that one cuff lies outwards and later forwards, i.e. at the front of the folded shirt. Another procedure consists in placing one sleeve upon the other sleeve that is folded inward so that the folded shirt does not show any visible cuff. After the sleeves are folded in one of these conventional ways, about 10 centimeters of the lower end or tail of the shirt is manually folded laterally onto the remaining lower part of the shirt. The handle 23 is then pulled downwardly by the operator to pivot the pivotable unit 2, 8, 23 and 24 downwardly about the axis 19 (clockwise into the FIG. 1 position) so that the forming plate 2 lies on the template. Now plate 5 is swung down to firmly clamp, against the plate 3, the lower area of the shirt with the shirt tail that has already been folded upwardly. Pairs of plates 6 and 7 are now automatically simultaneously pushed in, that is to say they are pushed inwardly over plates 2 and 3, in order to fold over and enclose the sides of the shirt between themselves and the plates 2 and 3, and a pin or clip is then manually placed, by an operator of the apparatus, in the material of the shirt where the folded-together shoulders meet, to keep the shirt in the desired arrangement.

The control of the apparatus is preferably such that the swinging down of the plate 5 actuates a micro-switch which thereafter passes impulses to pressure cylinders 39 (described hereinafter) which automatically push in the side plates 6 and 7.

The control is further such that, after the inward movement, all of the side plates 6 and 7 slide outwardly to their outermost positions (the FIG. 2 positions), which outward sliding of the side plates preferably occurs simultaneously. Thereafter plates 3 and 5 are raised a few centimeters. The shirt accordingly now lies with its lower part upon plate 3 and sidewardly folded around the forming plate 2 and the plate 5. The plates 3 and 5 are then, as a continuous operation after the raising, pushed further forward (to the left in FIG. 1) over the forming plate 2, whereby the lower part of the shirt surrounding plate 5 slides off from this plate and finally slides off from the foremost edge of plate 3, which is provided with a bulge, lip or the like extending across it, whereby this lower shirt part is thus folded over so as to overlie the upper shirt portion which surrounds the plate 2. As the plates 3 and 5 move to the left as viewed, they operate a micro-switch (not shown) which in turn actuates the cylinder to extend the guide bar 9. The leftward movement of the plate 5 causes the tail of the shirt to pass over the bar 9 and to come to rest under the tilting plate 8. After attaining their leftmost position, plates 3 and 5 move back. During this movement a cam actuates a one-way switch which actuates the cylinder 24 to extend the piston 25 to the right. This in turn moves the tilting plate 8 to the right. This movement causes the tilting plate 8 to initially "roll around" the lugs 21, freely pivoting at the knuckle joint 26, 27 to do so, to attain a horizontal position so that its rounded end 29 engages the tail of the shirt, held up by the bar 9 and by the raised ends of the guides 17, whereupon the plate 8 is displaced horizontally rightwardly and tucks the tail in between the raised back of the shirt (as held by the bar 9) and the plate 2. The guides 17 insure an accurate and true entry of the tucking-in plate 8 with no wobble, while the bar 9 insures a clean fold of the tail with no wrinkling of the material.

At the end of travel of the cam the switch is switched off and thus retracts the guide bar 9, and the tiltable plate 8 to the position shown in FIG. 1. The plate 5 resumes its inclined angle, about 120° with respect to plate 3, and this plate 3 along with plate 5 is returned in a diagonal, downward and outward (rightward) movement to the level of the heating plate.

Then the handle 23 is manually swung up (counterclockwise) and in doing so it swingingly lifts the forming plate 2 from which the completed folded shirt is lifted and removed.

FIG. 1 shows in greater detail the construction of the apparatus. A frame work 31 of the apparatus comprises, within end panels, vertical struts which are interconnected at their upper ends by e.g. tubular bearing elements 32 extending longitudinally of the apparatus.

Approximately centrally of the apparatus there is a beam 33 which extends in the longitudinal direction through the apparatus. Within the end panels the struts are interconnected near their lower ends by horizontal transverse elements provided with feet 34, the height of which is adjustable, and which can be made of tubes or the like which are slidable in the vertical direction and are securable by means of lock screws. At one long side of the apparatus the feet can be longer to enable inclination of the apparatus in the working position. For this purpose the foot ends can be somewhat oblique.

Below the bearing elements 32 and in the longitudinal direction of the apparatus 1 there extends for instance a pneumatic cylinder 35, the upper side of which can be provided with a longitudinal slot (not shown), out of which protrudes a carrier 36 connected to the cylinder piston and adjustably, which means by horizontal displacement, supporting a slider 37 which supports the hinge 4 and hence the plates 3 and 5. Slider 37 is slidably supported on the tubular bearing elements 32. As mentioned before, the guiding of plate 3 and thus slider 37 is such that, starting from the position shown in FIG. 1, a movement is obtained which is directed inclined upwards and leftwards in relation to plate 2.

The heating plate has wiring 38 for electrically heating the plate.

The beam 33 supports hydraulic and pneumatic cylinders 39 for movably actuating supporting bars 40, at the upper ends of each of which the respective plates 6 and 7 are supported adjustably about axles and by means of stop screws. There are altogether four bars 40 each supporting a plate 6 or 7. The lower ends of the bars 40 are swingable about lower axles 41 extending in the longitudinal direction of the apparatus and preferably between the ends of the transverse beams, whereby the plates 6 and 7 can swing transversely inwardly to overlie plates 2 and 3.

The beam 33 also carries a manometer 42 for controlling incoming pressurized air and carries a receptacle 43 for lubrication, which is fed via passages (not shown) to various points requiring lubrication.

FIG. 1 also shows a clamp strip 44 for electrical wiring and a control unit 45 which can be located lowermost in the apparatus.

The drawings show that all the sides of the apparatus are covered by protection panels or plates 46. The vertical edges of one panel can be secured to the struts on one longitudinal side of the apparatus, together with which pair of struts said plate is removable.

On that long side of the apparatus where an operator works, there can be outside the movable protecting plate 46 a so-called knee control 47 to be actuated by a knee of the operator to e.g. initiate a working operation. To the left of said control, the stationary part of the apparatus 1 can provide a keyboard with an emergency stop, control lamp and thermostat hand-wheel (all not shown) for adjusting the temperature of the heating plate.

In the drawings 48 designates a support for plate 5 in its upright position.

It will be understood that the term "shirts" used herein is intended to cover any similar garment such as a blouse, pajama top, sweater or similar article of clothing, whether with or without buttons or zips at the front or back, or with or without sleeves.

It will be further understood that the invention shown in the drawings and above described may be modified. For example, the tiltable plate may be curved so that it moves in an arcuate path to tuck in the tail of the shirt. Alternatively, the tiltable plate could be replaced by a spring plate. Also, though the heating plate has been described as being heatable, it may not be so, in which case it merely acts as a base plate or support plate of the apparatus.

The embodiments of the invention in which an exclusive property or privilege is claimed are defined as follows:

1. In an apparatus for folding a garment, such as a shirt, said apparatus including: a supporting plane for permitting a portion of the garment to be positioned thereon, the supporting plane having a collar expander associated therewith, a forming plate positionable over the supporting plane for permitting the garment to be folded thereabout, support means positioned adjacent one end of the supporting plane for supporting thereon the tail portion of the garment, means for moving the support means into a position wherein it overlies the forming plate for folding the tail portion of the garment over the forming plate so that the tail portion overlies the garment portion lying on the supporting plane, reciprocal means disposed adjacent the opposite sides of the forming plate for folding the side parts of the garment about lines which are substantially parallel to the longitudinal axis of the garment and are defined by the side edges of the forming plate, holding means movable into a position above said forming plate for holding the folded-over tail portion along a further folding line so that the free-end tail part of the folded-over tail portion is suspended downwardly from the holding means, and a device for tucking in the free-end tail part of the partially-folded garment about said further folding line so that said free-end tail part is inserted between the forming plate and the holding means, comprising the improvement wherein said device includes a tucking member mounted for tiltable movement between an upright position wherein it does not engage the partially-folded garment and a lowered position wherein it is disposed in a plane below the holding means for engaging the free-end tail part of the garment which is suspended downwardly from the holding means, said device also including means for moving the tucking member from said upright to said lowered position and then reciprocably moving the tucking member when in said lowered position in a direction substantially parallel to the longitudinal axis of the garment for causing the free-end tail part to be tucked beneath the holding means so as to be positioned between the latter and the forming plate.

2. Apparatus according to claim 1, wherein the tucking member rests with its lower side on an abutment about which it can tilt and which defines a tilting axis for the movement of the tucking member between said upright and lowered positions.

3. Apparatus according to claim 2, wherein the moving means includes a reciprocating drive member which is pivotally connected to said tucking member.

4. Apparatus according to claim 3, wherein the moving means comprises a fluid pressure cylinder, and wherein the drive member comprises a reciprocal piston rod associated with said fluid pressure cylinder.

5. Apparatus according to any one of claims 1–4, wherein the tucking member comprises a tucking plate which is tiltable between said upright and lowered positions about a substantially horizontal axis which extends substantially perpendicular to the longitudinal direction of the garment, said tucking plate having a free edge thereof which is substantially radially spaced from but extends substantially parallel with said axis, said tucking plate when in said lowered position being disposed approximately horizontally and with said free edge positioned for engaging the free-end tail part to insert the latter beneath the holding means when the tucking plate is reciprocably and linearly moved by said moving means beneath said holding means when in said lowered position.

6. Apparatus according to claim 1, wherein the holding means includes a reciprocal bar positioned to extend perpendicularly across and above the forming plate from a location adjacent one side of said supporting plane for defining a relatively straight fold as the free-end tail part is tucked beneath the holding means.

7. Apparatus according to claim 6, wherein the reciprocal bar is linearly reciprocated in its longitudinal direction by a fluid pressure cylinder.

8. Apparatus according to claim 1, wherein said forming plate has guide means thereon for reciprocably guiding the tucking member when the latter is in said lowered position and is reciprocably moved for inserting the free-end tail part beneath the holding means.

9. An apparatus according to claim 1, including hinge means associated with said forming plate for permitting the latter to be swingably moved upwardly away from its use position wherein it is disposed over the supporting plane into an inactive upright position, said hinge means defining a substantially horizontally extending hinge axis which extends perpendicular relative to the longitudinal axis of the garment and is disposed adjacent the other end of said supporting plane, a mounting member fixedly interconnected to said forming plate and positioned in the vicinity of said hinge means, said device being mounted on said mounting member so as to be swingably movable with said forming plate as a unit, said device including an abutment mounted on said mounting member and defining a horizontal tilting axis which is parallel to but spaced from said hinge axis, said tucking member comprising a tucking plate which has its lower side bearing on said abutment for permitting tilting of said tucking plate about said tilting axis between said upright and lowered positions, said moving means comprising a fluid pressure cylinder having a cylinder housing fixedly mounted on said mounting member and a reciprocal piston rod which projects from the cylinder housing and is pivotally connected to said tucking plate in the vicinity of said abutment, said tucking plate having a free edge which extends substantially parallel with but is substantially radially spaced from said tilting axis, said free edge being positioned for engagement with the free-end tail part when the tucking plate is in said lowered position.

* * * * *